United States Patent [19]

Fenster et al.

[11] Patent Number: 4,577,647

[45] Date of Patent: Mar. 25, 1986

[54] HAIR CURLER DEVICE

[75] Inventors: Larry A. Fenster, Roslyn, N.Y.; Fritz Hostettler, Freehold, N.J.

[73] Assignee: Mercury Foam Corporation, South Hackensack, N.J.

[21] Appl. No.: 667,330

[22] Filed: Nov. 1, 1984

[51] Int. Cl.[4] ..... A45D 2/02

[52] U.S. Cl. ..... 132/39; 132/43 R

[58] Field of Search ..... 132/39, 43 R

[56] References Cited

U.S. PATENT DOCUMENTS

| | | | |
|---|---|---|---|
| 618,630 | 1/1899 | Whelan | 132/43 R |
| 1,908,970 | 5/1933 | Frankel | 132/43 R |
| 2,061,817 | 11/1936 | Van Cleef | 132/43 R |
| 2,302,480 | 11/1942 | Tara | 132/43 R |
| 2,525,750 | 10/1950 | Spencer | 132/42 R |
| 2,630,127 | 3/1953 | Isbell | 132/40 |
| 2,862,508 | 12/1958 | Campbell | 132/39 |

*Primary Examiner*—Gregory E. McNeill

*Attorney, Agent, or Firm*—Fred A. Keire

[57] ABSTRACT

An improved hair curler device of a resilient outer sheath and a deformable shape retaining inner core embedded securely within the outer sheath; compositions for embedding deformable inner member within said outer sheath and an improvement in the outer envelope shape and texture for obtaining satisfactory hair curling properties.

7 Claims, 4 Drawing Figures

HAIR CURLER DEVICE

This invention relates to hair curler devices, more particularly this invention relates to hair curlers which have a resilient outer sheath of a specific outer skin properties in combination with a bendable inner shape in the form of a wire, a wire strand, or a flat shape in form of a strand. The wire or strand also carries in a twisted conformity or multiple strand conformity a number of transversely positioned anchor elements which securely embed the bendable inner core to the outer sheath member.

Still further, this invention relates to a type of hair curler which is adapted to have a lock of hair wound or wrapped around it. Thereafter the elongated hair curler body, due to the bendable inner core, can be bent and held in place for a sufficient time to achieve curling properties in hair, such as due to some setting lotions being applied thereto or due to moisture and/or heat being applied thereto.

BRIEF DESCRIPTION OF PRIOR ART

The applicant is familiar with the prior art to the extent of the patents listed herein:

U.S. Pat. No. 107,596 issued Sept. 20, 1870 to P. Ceredo;
U.S. Pat. No. 297,911 issued Apr. 29, 1884 to Blakesley;
U.S. Pat. No. 347,177 issued Aug. 10, 1886 to Heysinger;
U.S. Pat. No. 938,552 issued Nov. 2, 1909 to J. R. Bux;
U.S. Pat. No. 1,301,667 issued Apr. 22, 1919 to J. N. Eidt;
U.S. Pat. No. 1,320,099 issued Oct. 28, 1919 to Schloss;
U.S. Pat. No. 1,356,531 issued Oct. 26, 1920 to Klein;
U.S. Pat. No. 1,397,532 issued Nov. 22, 1921 to McClaire;
U.S. Pat. No. 1,406,586 issued Feb. 14, 1922 to O. Scheib;
U.S. Pat. No. 15,363 issued May 23, 1922 to K. McClaire;
U.S. Pat. No. 1,490,293 issued Apr. 15, 1924 to O. Scheib;
U.S. Pat. No. 1,552,618 issued Dec. 1, 1924 to Klemm, Jr.;
U.S. Pat. No. 1,523,962 issued Jan. 20, 1925 to Hitzigrath;
U.S. Pat. No. 1,619,743 issued Mar. 1, 1927 to K. McClaire;
U.S. Pat. No. 2,061,817 issued Nov. 24, 1936 to Van Cleef;
U.S. Pat. No. 2,074,816 issued Mar. 23, 1937 to L. Trotter;
U.S. Pat. No. 2,379,807 issued July 3, 1945 to H. H. Klein;
U.S. Pat. No. 2,838,054 issued June 10, 1958 to B. Fischer;
U.S. Pat. No. 3,459,200 issued Aug. 5, 1969 to Manderveld;
German Patent DE No. 3234672 Al issued Feb. 10, 1982 to Ehmann.

As represented by the above patents, the greatest effort has been expended in attempting to secure the inner bendable member within the resilient outer envelope or member and the securement of the bendable member in such a manner that the bendable member of the hair curler device does not penetrate the ends of the hair curler device and cause serious injury to the wearer of these devices. As it is well known, hair curler devices are worn during the day as well as during the night. These devices must be compliant and soft and at the same time have some body so that the shape can be obtained which would assure securement of a hair curler device to the hair without disengagement.

To this end, amongst the above-listed patents, various means such as glue have been used to secure the inner bendable member against movement, e.g., large portions of the bendable member have capping enlargement of the bendable member. Capping devices and capping and the like have been sought to produce a nondisplacable central bendable member within the outer sheet of the resilient member. The prior art devices, however, suffer from a number of shortcomings.

BRIEF DESCRIPTION OF THE INVENTION

It has now been found that a properly co-acting bendable member has been invented. The hair curler devices of this invention have bendable members in the form of a single or a plurality of wires carrying thereon affixed in a secured position transverse anchoring members such as transverse strands of resilient members. These resilient members may be the same material of which the outer envelope or sheath is formed or other materials which assure anchoring of the bendable core element to the outer flexible sheath member. These bendable members as now formed provide especially secure anchoring of the bendable inner core and thus assures positive engagement of the inner core within the outer flexible sheath. At the same time, the novel combination assures greater security to the wearer under all conditions.

As a consequence of the present invention, the central bendable core member need no longer have end portions enlarged or crimped or secured in one form or another to the flexible sheath. However, these additional means enhance the present device to a small degree still further.

In accordance with the present invention, the embedding during the manufacturing process of the transversely positioned securement elements such as strands, sheet-like members, foils, crimped fibers, bristles, etc., provides extremely safe hair curling process.

Moreover, the optional feature of enlarging the ends of the hair curling device for embedding additionally shaped central bendable member with enlarged end shapes within an enlarged bell-like or barbell-like end pieces further assures the outstandingly secure placement of the bendable member within the outer sheath member.

Still further, it has been found that an appropriate reactant adhesive, as further described herein, if used in conjunction with the bendable member, secures still further the bendable central member to the flexible foam-like outer sheath member and provides for extremely desirable central bendable portion securement to the outer sheath foam-like element.

Still further and as another cooperating element, it has been found that providing an appropriately textured outer surface, an exceptionally outstanding end result is achieved due to the surface characteristics interacting with the described hair curling device and hair being curled. In combination with the bendable central portion which can be tailored to the desired stiffness (and marked accordingly in the display and point-of-sales packaging and/or color coding), variously bendable inner core members may be fashioned from wire strands or metal bands or foils singly or twisted together and additionally and preferably transversely secured to the inner core. This combination of the surface characteristics with bendable, securely bonded characteristics as well as the given resiliency of the sheath member provides the consumer with a great choice of the devices most appropriate for the consumer.

As another advantage of the present invention, the bendable inner element as secured within the outer sheath member can be formed in a single stage foaming operation when the inner member is surrounded by the flexible foam sheath. This is accomplished by appropriately placing a few spacer strands, preferably of the same material as the flexible foam, in the shape of smaller rods, sheets, bosses and the like at appropriate intervals and then after the forming process, allowing these shapes to be appropriately employed as spacers during the foaming process.

DESCRIPTION OF THE DRAWINGS AND EMBODIMENTS OF THE DEVICES

In the drawings which accompanies and forms a part of the specification and disclosure, and in which like numerals or references designate corresponding parts found in the several views.

Figure 1:
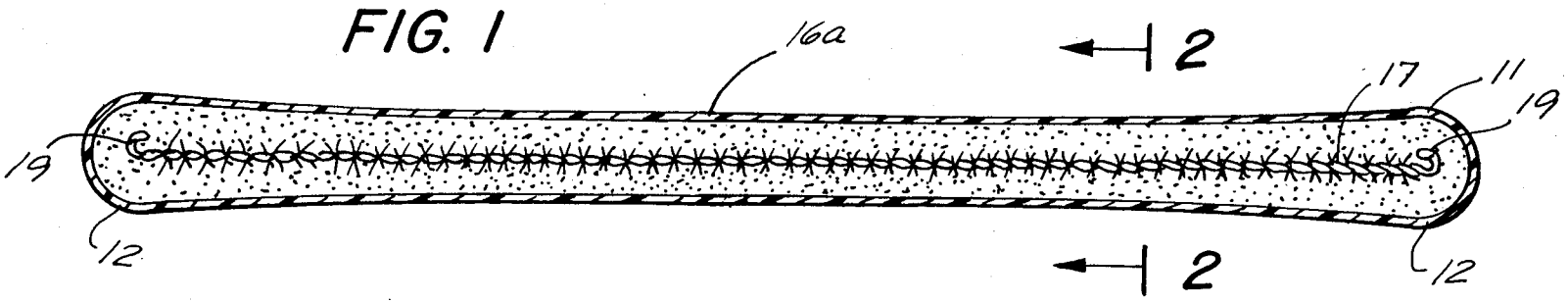
FIG. 1 is a longitudinal cross-section of the curler showing the inner bendable core member and the outer flexible sheath, and the appropriate outer skin characteristics for the outer member.

Turning now to the perspective view show in FIG. 1, the hair curler device 11 has typically enlarged end portions 12 each at the opposite end of the curler device. Although typically the hair curler device 11 may be a straight rod, other shapes are also possible, along the longitudinal axis thereof. The hair curler device 11 may replicate any desired mold configuration. Such mold configurations may be symmetrical, non-symmetrical or concentric or non-concentric around the longitudinal axes. These devices have found favor when imparting different curl configurations to one or more locks of hair which have been wound or wrapped around the hair curler device.

Figure 4:
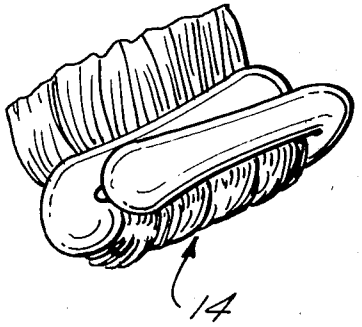
FIG. 4 is a perspective view showing of a hair curler device with a lock of hair wound therearound and as worn by a user.
Figure 3:
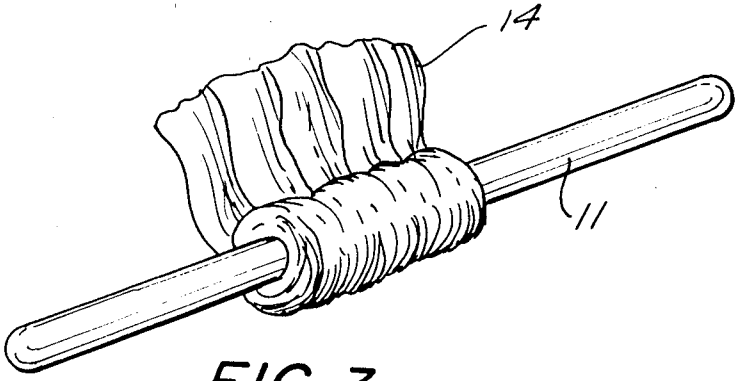
FIG. 3 is a perspective view of the hair curler device with a lock of hair during the winding process.

Turning further to the hair curler device, the lock of hair wound around the device is shown as 14 in FIGS. 3 and 4.

As previously mentioned, if different outer surface configurations are replicated from the mold, the hair curler device may provide different curl properties to the lock of hair which has been wound around the hair curler device by appropriate means.

Figure 2:
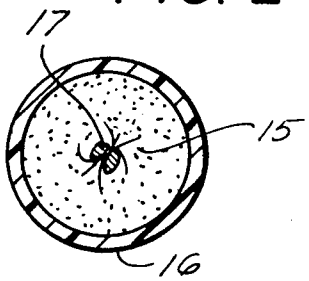
FIG. 2 is a transverse cross-sectional view along lines 2—2 of FIG. 1 allowing the placement of the core member.

With respect to the cross-section shown in FIG. 2, the core member 15 is typically a wire such as a copper or aluminum wire to which have been affixed permanently in an anchor-like fashion other cross members 17. Core member 15 may be in the form such as a pipe cleaner or lamp or bottle cleaner of strands preferably of the same material of which the hair curler device is formed and are transversely affixed to the bendable core member. Magnetically susceptible metal, core member 17 may also be severed in a mold by magnetic bases protruding from one half of core member (not shown).

The transverse strands 17, for example, may be of polyurethane or polyurethane foam material, which in turn may be a fully reticulated or conventional foam material, i.e., of the same material of which the flexible sheath member 16 is made. Although these transverse members have been shown in a single length, these may be of a randomized nonuniform length and of various materials, and these members may be inserted of various strand thickness and various configurations such as multiple strands, single strands, monofilaments, etc. Each of the anchor member extending transversely such as perpendicularly or in a general manner transversely to the inner core member. As mentioned before, these strands may also be of a flexible foam-like material of different densities and pore sizes, thus allowing to embed with greater security (in the sheath material as it is being molded) the bendable central portion thereof.

Still further, the central core member 15 may consist of a single or a plurality of strands in which the anchoring members and/or wires are of various sizes and/or gauges as well as bendable characteristics. Thus the central core member as anchored may be anchored with great assurance within the flexible sheath foam 16, depending on the resilience for the flexible sheath foam 16 desired by the wearer, as well as the outer skin 18 characteristics as desired by the wearer.

Upon use, as it is well known, the end portions of the bendable central member 15 are bent. The opposite edges and core, of course, have a radius different from the radius of either the inner bend radius or the outer bend radius for the hair curler device. The typically cylindrical hair curler device 11 has in the flexible foam sheath 16 different stress characteristics throughout the bend. Typically, these stress characteristics associated with the bendable member 15 produce the separation and cause the core member to be displaced in use or after repeated bending.

In the present device, the secure anchoring of the central core member is such as by the previously described pipe cleaner-like transverse protrusions or even larger protrusions (which may reach or even, if desired, penetrate the outer skin when made of the same foam material). These provide the secure anchoring unaffected by the stresses imposed on the central core member.

As a typical example, the bendable core member may be an aluminum wire, a mild steel wire, a copper wire, or the like. Typically the ends of the bendable member 15 may be further formed into a desired shape such as shown by the shape 19 of end shaped portion which can then be displaced or disposed within the device depending on the end configuration of the member. The additional securement then also assures further security against the displacement of the flexible member 15 longitudinally or transversely through the end member.

Still further, and as mentioned before, the transverse anchoring elements 17 may be of individually interspersed foam shapes such as rods, bars, cylinders and the like, or further monofilaments interspersed with foam members or any combination of these, providing the securement of the core member during its repeated bending use. The flexible sheath foam member 16 is typically made of polyurethane such as polyether or polyester polyurethane foam and the foaming operation in a mold is accomplished either with the wire being in place as the mold cavity is being filled, or partially filling a mold cavity embedding the wire in the partially filled cavity which contains the foam precursor polymer and then enclosing the foam formers in the cavity and injecting additional foam precursor or any combination of these.

Still further, the flexible sheath member may also be made such as of foamed, vulcanized rubber or foamed polyethylene or foam polyvinyl and like materials known to be foamable under like conditions.

In order to obtain the outer skin configurations for the hair curler device which find great favor with the user, the mold cavity may have the mold walls heated and thus various foam texture or foam skin 18 characteristics obtained for the hair curler device. These characteristics have been found to be especially desirable depending on the texture of the hair which varies from person to person. The foam formulation may also be compounded to impart the desirable foam "skin" properties.

The resilience of the foam is measured by the test conventionally employed in foam manufacture. The skin properties are measured such as by abrasion, resistance to penetration, knife-cut propagation and like measurements well known in the art.

In accordance with the present invention, these properties are best established on a scale based on the texture. The texture is based on the foam pore size density by establishing a pore count along a lineal inch. Inasmuch as these are mostly micropores for the skin properties or very fine pores, these are measured by employing an appropriate device such as magnifying device or microscope. Pore sizes range from about, e.g., 140 pores per lineal inch to about 25 pores per lineal inch.

Conversely, the adhesives which are today found for the purpose may also be employed to glue onto the bendable center portion wire, which then may be either a single strand or other twisted strand of a plurality of wires. These anchoring means, such as the above-mentioned reticulated foam for anchoring, allows the center wire to be placed in the hair curler device 11.

Thus the prior art deficiency of the bendable foam hair curler presently being manufactured is overcome by establishing the right coefficient of friction between the surfaces formed by the outer surface of the foam facing the outer surface of the human hair. A high coefficient of friction of this foam surface will increase the tendency to pinch and pull the hair from the scalp when separating the tightly wound hair from the curler. Conversely, when the coefficient of friction of the interface is lowered, this will facilitate the separation of the hair curler from the hair. However, introducing a stiffer, i.e., less resilient skin, also introduces additional stress in the hair curler device which is, however, accomodated by the proper anchoring means.

In order to still further increase the bond between the bendable metal core and during the encasing of the bendable metal core within the foam, the compositions which have been employed for this purpose are used in a series of heating the bendable metal core. A degreasing liquid such as a chlorinated hydrocarbon is first employed. Thereafter, an acid etching treatment, for example with phosphoric acid or other acids of various strengths is used as an etchant. The degreased or the etched metal core core can be bonded directly to the microcellular polyurethane by means of the normal foaming process. A preferred method consists of the use of epoxy, acrylic, or urethane primer surfaces on the metal surface. A still more highly preferred method consists of the use of organofunctional silanes in combination with organic primers. Amino silanes are generally preferred in combination with urethane primers, epoxysilanes are used in combination with epoxyprimers, and vinyl or methacryloxoysilanes are used in combination with acrylic primer surfaces. The silane treatment can be applied to the metal wire prior to applying the primer coat, or the silane may be incorporated into the organic primer formulation. It is also feasible to treat the metal wire with the silane and follow this quickly with the microcellular foaming operation for forming the hair curlers. Typical aminosilanes are $NH_2(CH_2)_3Si(OC_2H_5)_3$ and $NH_2(CH_2)_2NH(CH_2)_3Si(OCH_3)_3$ (available from Union Carbide Corp.). Typical vinyl silanes are $C_2H_3Si(OC_2H_5)_3$ and $C_2H_3Si(OC_2H_4OCH_3)_3$. Typical methacryloxysilanes are $CH_2CCH_3COO(CH_2)_3Si(OCH_3)_3$ and $CH_2CCH_3CO_2(CH_2)_3Si(OC_2H_4OCH_3)_3$. Typical epoxysilanes are

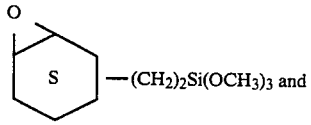

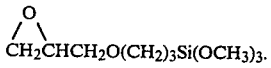

After this treatment, the amino silane compound is typically reacted with the polyurethane foam, that is as it is foamed during the foaming operation.

Based on the above disclosure and based on the experience, the bendable metal wire thus stays in place in the hair curler device. The life cycle of the hair curler is increased. Moreover, the likelihood of injury is drastically minimized, if not substantially eliminated.

In addition and for esthetic reasons, the hair curlers may be formed of polyurethane foams having pigments dispersed therein. These pigments may impart the desired color to the hair curler device.

With respect to the coefficient of friction which has been found to be especially acceptable for the outer skin, it has been determined, as mentioned before, by typical coefficient measurements such as by dragging a given conforming sample across the curler. The coefficient of friction for comparable foams may also be established based on the scale of zero to ten. On that scale, the coefficient of friction from about 5 to 8 or even up to 9 has been found to be most acceptable. A value of 0 represents the least friction of available foams. A value of 10 represents the highest friction foams.

Still further, during the wire treating process, i.e., when employing degreasing, scouring, etching steps, etc., appropriate primers are used. During or after the priming process of the bendable wire, the anchoring members may be glued on the wire.

As primers, the amino silane compounds are preferred, other priming compounds may be employed such as polyacrylate and amino silane group carrying polyvinyl alcohols or reaction products with polyvinyl alcohol, i.e., pendent amino silane reaction products.

These priming compositions are well known in the art and need not be discussed in greater detail.

EXAMPLE

A hair curler was made in the following manner:

1. A readily bendable, galvanized steel wire having a diameter of 0.05 inches, and a length of approximately 9.5 inches was vapor degreased with 1,1,1-trichloroethane and allowed to dry. The wire was then dip-coated with a polyurethane primer elastomer containing 0.5%, by weight, of gamma-aminopropyltriethoxysilane.

This dip-coating mixture was prepared by admixing 0.1 equivalent (165 gm.) of Voranol 4701 polyether polyol (an ethylene oxide end-capped polymer of propoxylated glycerol having a hydroxyl equivalent weight of about 1650 available from Dow Chemical Company) was admixed with 1.5 gm. of gamma-aminopropyltriethoxysilane, 5 gm. of diethylene glycol, and 100 gm. of methylethyl ketone. To this mixture, there was added 33.0 gm. of Isonate 181 (NCO equivalent weight of 184, available from the Upjohn Company). This compounds is a prepolymer from a mixture of di- and tripropylene glycols and 4,4'-diphenylmethane diisocyanate.

The metal wire is dipped inot the above-described coating solution, heated in a 100° C. oven for a few minutes, removed and allowed to air cure overnight. Next day, the wire was inserted on two magnetic posts inside a plastic mold (not shown). The two mold halves of the mold cavity, which were designed to give a hair curler of 10.5 inches in length and about 0.6 inches in diameter, were closed, held together by means of two clamps, and there were injected from a foam machine 12 gm. of a microcellular polyether urethane formulation, designated as System X-220B, available from Plas-Tech Systems, Inc., Farmingdale, N.J. 07727. This formulation is a cold-cure polyether system based on a water-based polyether polyol blend and a prepolymer from 4,4'-diphenylmethane isocyanate and a polyether diol. These formulations provide for the appropriate friction characteristics. After five minutes, the hair curler is demolded and allowed to stand overnight.

Upon examination it was observed that the microcellular foam adheres extremely well to the galvanized metal wire. Upon repeated bending of the end of the curler, the metal wire foam/composite stays intact.

As a comparison, the above procedure was repeated with an untreated metal wire. The microcellular foam exhibits insufficient adhesion. Upon bending, it is possible to damage the hair curler end sufficiently to make the wire penetrate the foam after repeated flexing.

In a similar manner, in accordance with this invention multiple strand wires, wires with bristles, etc., are prepared with superior characteristics.

What is claimed is:

1. A hair curler device having an outer skin of predetermined frictional characteristics, a resilient foam sheath of a foamed material and a bendable core element having anchoring means for binding the same to the resilient foam sheath, wherein the anchoring means consist of adhesive securement or transversely positioned elements disposed within and transversely to the longitudinal axis of said hair curler device and embedded in said hair curler foam sheath.

2. The device as claimed in claim 1 wherein the transverse elements affixed to said bendable core element comprise bristles, sheets, rods, bars or films disposed along said bendable core element at interspersed intervals thereof of a pre-selected transverse length.

3. The hair curler device as disclosed in claim 1 wherein the bendable core element at the ends thereof has enlargements for further securement of the bendable core element in said hair curler device at ends thereof.

4. The device as disclosed in claim 1 wherein the foam sheath ends of the hair curler device are enlarged for securement of additional anchoring means within said enlarged portion thereof of the bendable members thereof.

5. The hair curling device as described in claim 1 wherein the bendable core element adhesive securement is by a primer carried on said bendable core element.

6. The hair curler device as disclosed in claim 1 wherein the hair curler device is of polyurethane foam having a skin coefficient of friction in the range from 5 to 9 on a scale from 0 to 10.

7. The hair curler device as disclosed in claim 1 where the bendable core element has attached thereto securement means for chemically interacting with said foam and for anchoring said core element to said foam sheath.

* * * * *